United States Patent [19]

Arzt

[11] 4,141,395

[45] Feb. 27, 1979

[54] LOG SPLITTER

[76] Inventor: Allan H. Arzt, Box 392 King Ave., Baltimore, Md. 21237

[21] Appl. No.: 821,754

[22] Filed: Aug. 4, 1977

[51] Int. Cl.[2] ..... B27L 7/00

[52] U.S. Cl. ..... 144/193 R; 144/3 K; 180/53 WA

[58] Field of Search ..... 269/240, 244; 144/3 K, 144/193 R, 323; 74/13, 15; 180/53 R, 53 B, 53 WA

[56] References Cited

U.S. PATENT DOCUMENTS

| | | | |
|---|---|---|---|
| 140,404 | 7/1873 | Coe | 269/244 X |
| 1,189,999 | 7/1916 | Peter | 144/193 R |
| 1,487,962 | 3/1924 | Manville | 180/53 WA |
| 2,137,940 | 11/1938 | Goodman | 180/53 WA |
| 3,717,045 | 2/1973 | Burenga | 74/13 X |

FOREIGN PATENT DOCUMENTS

| | | | |
|---|---|---|---|
| 231752 | 4/1944 | Switzerland | 144/193 R |

*Primary Examiner*—Donald R. Schran
*Assistant Examiner*—W. D. Bray
*Attorney, Agent, or Firm*—John F. McClellan, Sr.

[57] ABSTRACT

A log splitter having a wedge and a vehicle powered screw and nut mechanism for forcing logs against the wedge. A wheel of a powering autmotive vehicle is run up an incline and down into a "socket" formed by two parallel rollers to be turned by it; each roller is an integral coaxial part of a respective screw shaft extending laterally past a fixed inward facing wedge; a member spanning the screws comprises a nut threadedly engaging each screw with the span between the threaded portions reinforced for thrusting logs against the wedge. Safety anti-overrun features include relieved portions at each end of the screw threads and an automatically unlocking pawl used in removing the vehicle from driving engagement; an automatic rewind feature is included in an embodiment.

10 Claims, 7 Drawing Figures

LOG SPLITTER

This invention relates generally to log splitters and specifically to screw-advance log splitters.

In the prior art numerous disclosures have described mechanisms of the type including the following U.S. Pat. Nos.:

885,458 to P. Ekenroth, Jr., 4-21-08, discloses a fixed wedge opposing a powered pusher within a longitudinal framework of beams;

953,162 to J. Weinberg, 3-29-1910, discloses a threaded-cone stump splitter;

1,189,999 to F. Peter, 7-4-16, discloses belt-driven worm and worm wheel screw-advanced mechanism for forcing a log against a wedge;

2,612,194 to R. P. Ingraham et al, 9-30-52, discloses paired opposed knife members which can be considered wedges, one forced against a tree to be cut and forcing the tree against the other, by means of a screw. The work (the tree) is positioned between side rails locating the blades;

3,993,113 to R. H. Thackery discloses a vehicle-axle-mounted threaded cone for log splitting, the vehicle axle being jack-supported on a frame that extends out and holds the log to be split against the auger action of the threaded cone.

In addition, U.S. Pat. No. 3,937,260 discloses use of twin piston and cylinder assemblies to draw a blade along a log.

However, the combination of relieved twin screw and twinned-nut structure and non-overrun provisions disclosed herein are believed unique and not suggested by the prior art, nor is the rewind structure believed so suggested.

A principal object of the present invention is to provide low bending stress apparatus for splitting logs, which can thereby be made lighter and to split longer logs than previously available devices of the type.

Further objects are to provide a log splitter as described which can be both powered and stabilized by a motor vehicle with convenience, economy, and variable speed, with safety against overrun in engaging and disengaging the motor vehicle.

Yet further objects are to provide a log splitter which is capable of splitting short logs in series, and which can automatically rewind itself to a setting for further splitting.

And further objects are to provide a log splitter as described which is economical to construct, compact, durable, damage resistant, easy to maintain, simple to use, and pleasing in appearance.

The above and other objects and advantages of this invention will become more readily apparent on examination of the following description, including the drawings, in which like reference numerals refer to like parts:

Figure 1:
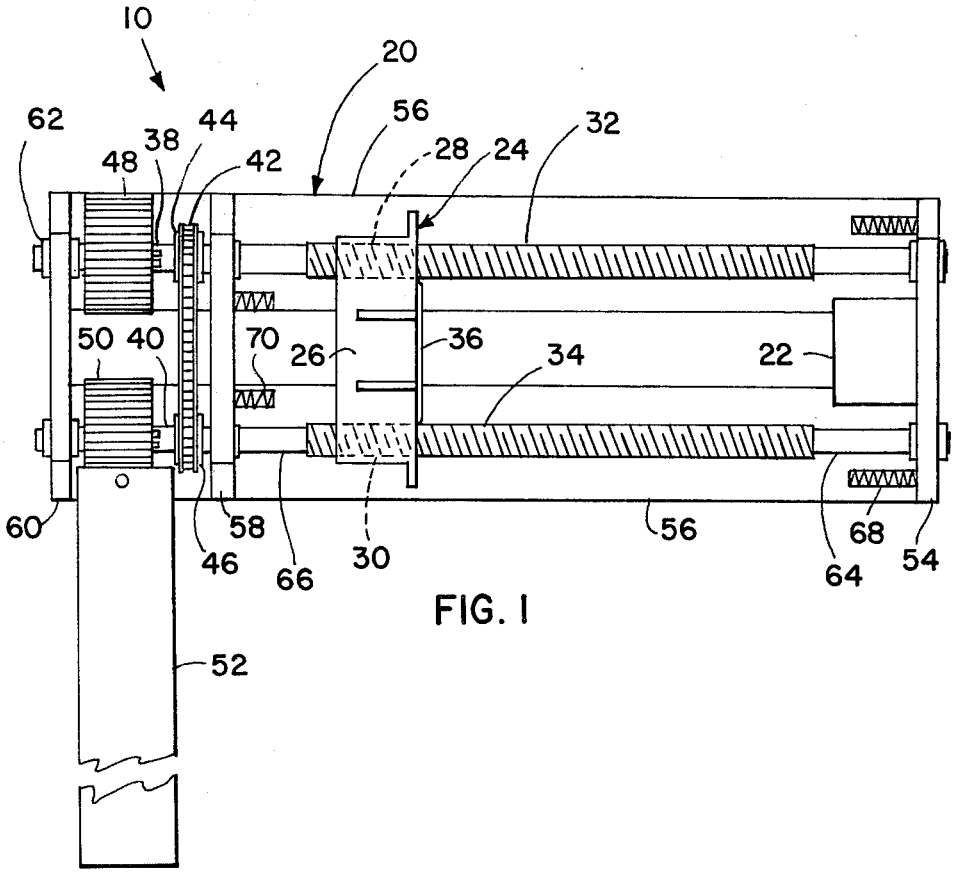
FIG. 1 is a plan view.
Figure 2:
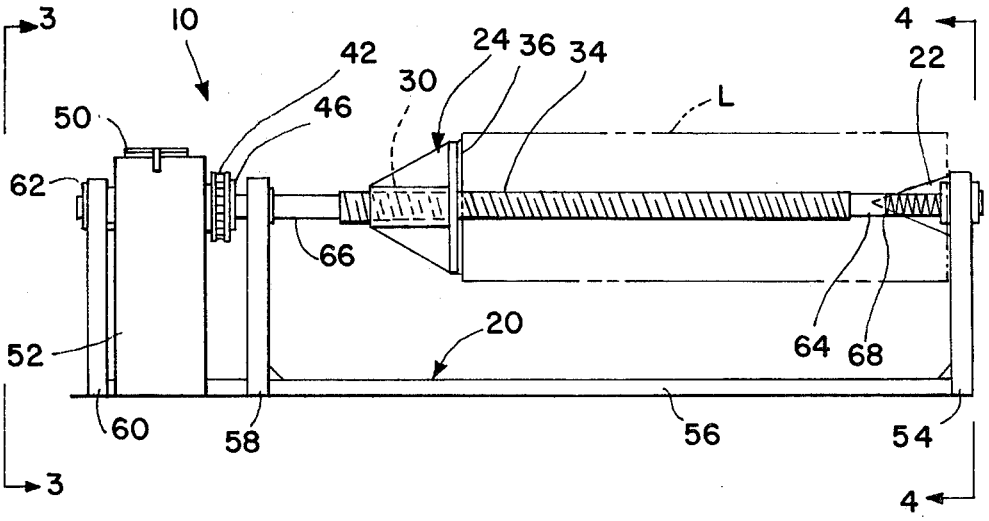
FIG. 2 is a side elevational view.

FIGS. 1 and 2 show the invention in embodiment 10 comprising a longitudinal frame 20 with, at the first end a wedge 22 fixed transversely and facing inward.

Horizontally opposing the wedge is a nut yoke 24 having a span portion 26 for urging a log to be split against the wedge, and first and second portions 28, 30, threadedly engaging the nut yoke to respective parallel dual screws 32, 34, preferably identical, which advance the nut yoke toward the wedge, urging splitting-coupling of a log (coupling necessary for splitting logs) between the dual screws and the wedge, and which retract it from the wedge. The wedge and the forward, buttressed pressing plate 36 on the nut yoke are centered in the plane of the screws, in alignment with the necessary splitting forces. The screws comprise threaded portions of respective shafts 38, 40 synchronized at an intermediate location by a chain 42 engaging respective spur gears 44, 46 on the shafts.

First and second friction drums 48, 50 concentrically fixed on the respective shafts and equally spaced from the second end of the frame provide in the spacing between and above them a "socket" for receiving a drive wheel of a vehicle such as a pickup truck rear wheel which may be backed up a ramp 52 and dropped into the socket as power drive for splitter.

A first upright 54 rising from the frame bed 56 supports the wedge and journals the first ends of the shafts; similarly a second upright 58 journals an intermediate portion of the shafts, and a third upright 60 journals the second end of the shafts. Thrust collars 62 preferably are provided fixed on the shafts on either side of the first and third or end uprights.

The shafts have respective screw thread reliefs or plain undercuts 64, 66, adjacent the first and second uprights, of approximately the inside diameter of the female screw threads in the nut yoke and of sufficiently greater length than the female screw-threaded length to prevent screwing the nut against the wedge in splitting and against the second upright in retracting. A pair of compression springs 68 extends outboard the screws toward the nut from the first plate, and similarly from the second plate at 70, preferably inboard the screws, for reasons described next in reference to operation of the apparatus.

For operation, a vehicle drive wheel is run up the ramp, a log L, (FIG. 2), is placed between nut and wedge, shimmed up from beneath as required, and the vehicle drive wheel is driven at any convenient speed in a direction advancing nut and log toward the wedge. After the log splits apart and clears the mechanism the direction of rotation is reversed, retracting the nut yoke to a position for receiving a succeeding log between the screws.

It can be seen that bending loads on the screws are avoided since both are in tension in line with the nut yoke and wedge. Further, when the nut yoke reaches the end of travel, the shafts effectively become idlers rather than jamming; the vehicle wheel spins the idling shafts rather than jumping out of the socket as result of shaft stoppage at the end of travel; the compression springs bias the nut yoke into threaded engagement with the screws for re-engagement when the direction of rotation is reversed in each case.

The simplicity and spaciousness of the apparatus will be appreciated; except for heavy structure at the nut yoke to accommodate offcenter loads, the remainder of the structure is relatively lightweight; the bedplate beams may be deeper under the vehicle location than under the log location where clearance is desirable and loads are taken above. Logs L may be elevated by levering or by a jack frame, until grasped between nut plate and wedge. After splitting they can fall free in normal operation.

Figure 3:
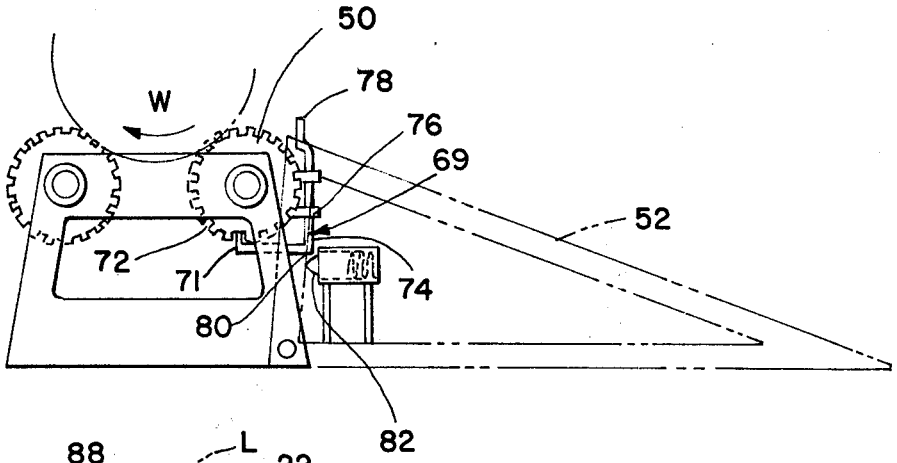
FIG. 3 is an end elevational view taken at 3—3, FIG. 2.

FIG. 3 shows the relation of ramp and frame at the second end, and a safety latch 69 used in offloading the vehicle wheel. With the safety latch in the up position shown, the upturned part 71 of the horizontal portion of the "L" shaped latch unit engages one of a number of separate apertures 72 in the periphery of the friction drum 50 nearer the ramp, so that the vehicle wheel finds the friction necessary for climbing up over that friction drum to descend the ramp.

As an automatic safety release to prevent the friction drum from remaining locked, with possible unwanted jumping-out by the vehicle the next time the unit is used, the upright arm 74 of the "L" shaped unit is slidably held to the frame as at 76 so that the vehicle wheel depresses it from the upper end 78 when the vehicle wheel first starts to roll on the ramp. This forces the angle junction 80 of the "L" down past spring-loaded bullet-plunger keep 82 which then can no longer maintain the safety latch in the up or operative position, permitting the shafts to spin freely.

The rotation of the vehicle wheel, with right hand screws as shown, is in the same direction for retracting the nut yoke as for leaving the socket. Accidental overrunning by providing resistance for the wheel permitting it to rise and roll over drum 50 is prevented thus by two means, the automatic unlocking and the thread relief at the retracted position of the nut yoke near the second upright.

Figure 4:
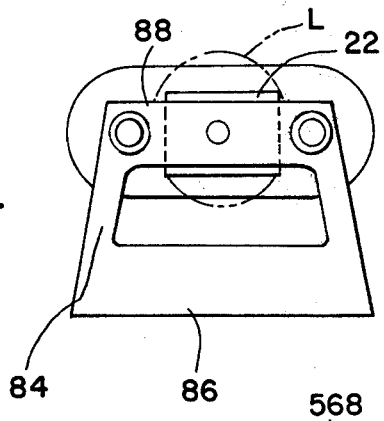
FIG. 4 is an end elevational view taken at 4—4, FIG. 2.

FIG. 4 shows the first end of the frame as preferably having angled inwardly side member 84 connected at the bottom by a transverse plate 86 and similarly at the top; the top plate 88 is preferably as shown, shallower than the base of the preferably 45° to 90° included-angle wedge 22, which extends almost from screw to screw.

Figure 5:
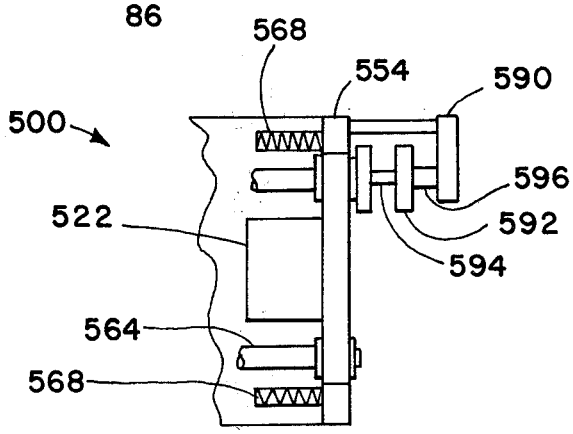
FIG. 5 is a plan view fragmentary detail of a modified embodiment.
Figure 6:
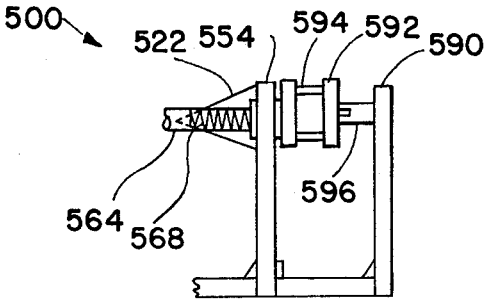
FIG. 6 is a side elevational detail thereof.

FIGS. 5 and 6 show a detail of embodiment 500 similar to embodiment 10 but having connected to the first upright 554 of the apparatus a bracket 590 holding a self-rewind spring 592 which may be a flat coil spring, coaxially generally with one of the shafts, to the end of which it has dog-drive connections 594 or other suitable conventional connection to the outer coil.

In operation, the spring 592 winds up on fixed, split stub 596 holding the inner coil while a log is being split, and when the power is released, rewinds the screws, restoring the nut yoke to position near the beginning where the compression springs 68 offer sufficient resistance to prevent complete unwinding.

Figure 7:
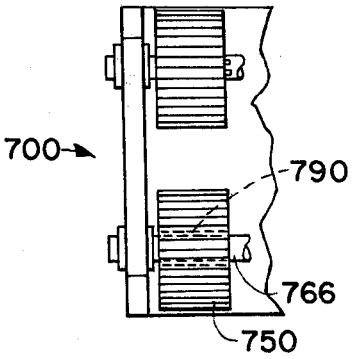
FIG. 7 is a plan detail of a further embodiment.

FIG. 7 shows an alternative embodiment 700 which has further an anti-jam feature and is otherwise the same as embodiment 10. In this embodiment friction drum 750 has a free-running connection to shaft 766 through bushing 790. Regardless of whether an unsplittable object is placed in the device, the vehicle drive wheel still cannot climb out over this free spinning drum until the drum is locked by the safety latch as described above.

Generally from the description of this invention, the extreme simplicity, ruggedness and damage resistant features such as the unitary nut yoke which inter-supports the screws will be apparent.

It will also be appreciated that the invention is adaptable to many different installations. For example, it can be installed in a ditch or trench so that the vehicle can run onto it almost level; or, a second ramp like the first can be provided in parallel with the first to keep paired back wheels of a vehicle level in ascending the ramp.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. In a log splitter having a wedge, means for splitting logs with the wedge, including screw structure and drive means therefor and means engaging the screw structure and travelling therealong when the screw structure is rotated for urging the screw structure engaging means toward the wedge to split a log with the wedge, said drive means including an adapter attached to the screw structure permitting use of a motor vehicle drive wheel when placed thereon to rotate the screw structure with the periphery of the drive wheel, the improvement comprising: means for preventing a said motor vehicle drive wheel when on the adapter, from over-running the adapter, said means engaging the screw structure defining means for aligning log-splitting loads with the screw structure for minimizing bending stress on the screw structure during splitting, and means limiting travel of the screw structure engaging means along the screw structure.

2. In a log splitter as recited in claim 1, the means for aligning log splitting loads including: the screw structure comprising parallel-spaced dual screws and the means engaging the screw structure comprising a nut yoke having part thereof threadedly engaging the dual screws, the wedge being fixed transversely at a first end of the log splitter and facing inwardly between and in the plane of the dual screws, a portion of the nut yoke spanning the dual screws in opposition to the wedge in position for urging toward the wedge said a log when positioned between the dual screws, and means for synchronizing rotation of the dual screws.

3. In a log splitter as recited in claim 2, the means for synchronizing including a respective gear on each of said dual screws, and means linking said gears in rotation.

4. In a log splitter as recited in claim 2, the means for preventing a said motor vehicle drive wheel from overrunning the adapter including: the adapter comprising the following structure: each of said dual screws having a shaft extending coaxially therefrom to a second end of the log splitter, a friction drum member on each shaft, the friction drum members being equally spaced from said second end for receiving in a socket formed by and between the friction drum members a motor vehicle drive wheel, and said means for limiting travel causing said shafts to idle when the nut yoke is drawn proximately toward the second end of the log splitter.

5. In a log splitter as recited in claim 4, the means for causing said shafts to idle including screw-thread relief at an end of each screw located for receiving the nut yoke threaded engagement part on retraction of the nut yoke to a limiting position away from the wedge.

6. In a log splitter as recited in claim 5, and means for biasing the nut yoke toward threaded engagement with the dual screws when at said first screw thread relief.

7. In a log splitter as recited in claim 5, and means for locking the shafts when removing a said motor vehicle drive wheel from said socket; the means for preventing a said motor vehicle drive wheel from overrunning the adapter further comprising: means for unlocking the locking means, the means for unlocking located for actuation by a said vehicle drive wheel immediately upon leaving said socket.

8. In a log splitter as recited in claim 4, the means for preventing a said motor vehicle drive wheel from overrunning the adapter further comprising means mounting one of said friction drum areas for free-running rotation on one of said shafts.

9. In a log splitter as recited in claim 2, the means for limiting travel of the screw structure engaging means including screw thread relief at an end of each screw, located for receiving the nut yoke threaded engagment part on advancement of the nut yoke proximate the wedge.

10. In a log splitter as recited in claim 9, and means for biasing the nut yoke toward threaded engagement with the dual screws when proximate said screw thread relief.

* * * * *